US011596226B2

(12) United States Patent
Chiao et al.

(10) Patent No.: US 11,596,226 B2
(45) **Date of Patent: *Mar. 7, 2023**

(54) WIRE SHELF

(71) Applicant: TRINITY INTERNATIONAL INDUSTRIES, L.L.C., Carson, CA (US)

(72) Inventors: Jerry Chiao, Newark, CA (US); Yuan-Luen Chuang, Shanghai (CN); Cze-Chao Tam, Palos Verdes, CA (US)

(73) Assignee: TRINITY INTERNATIONAL INDUSTRIES, L.L.C., Carson, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/649,327

(22) Filed: Jan. 28, 2022

(65) Prior Publication Data

US 2022/0167742 A1 Jun. 2, 2022

Related U.S. Application Data

(63) Continuation of application No. 17/147,207, filed on Jan. 12, 2021, now Pat. No. 11,297,943, which is a continuation of application No. 16/571,752, filed on Sep. 16, 2019, now Pat. No. 10,905,236.

(51) Int. Cl.

| | |
|---|---|
| ***A47B 57/58*** | (2006.01) |
| ***A47B 47/00*** | (2006.01) |
| ***A47B 87/00*** | (2006.01) |

(52) U.S. Cl.

CPC ..... *A47B 57/581* (2013.01); *A47B 47/0091* (2013.01); *A47B 57/585* (2013.01); *A47B 87/001* (2013.01)

(58) Field of Classification Search

CPC ..... A47B 57/581; A47B 57/585; A47B 55/02; A47B 87/001; A47B 47/0091

See application file for complete search history.

(56) References Cited

U.S. PATENT DOCUMENTS

| | | | | |
|---|---|---|---|---|
| 573,835 A * | 12/1896 | Taylor | A47G 25/743 | 211/175 |
| 1,257,843 A * | 2/1918 | Gonyea | A47B 35/00 | 248/172 |
| 2,319,470 A * | 5/1943 | Nobles | F25D 25/02 | 211/153 |

(Continued)

FOREIGN PATENT DOCUMENTS

DE 3306558 A1 * 8/1984

*Primary Examiner* — Stanton L Krycinski

(74) *Attorney, Agent, or Firm* — Innovation Capital Law Group, LLP; Vic Lin

(57) ABSTRACT

A storage solution uses wire shelves where the width of the wire shelves can be customized by a user by adding one or more central members between two end members. Thus, the shelving can be installed in one cabinet having a first width, and moved, if desired, to a cabinet of a different width by adding or removing central members from the shelf. Further, a manufacturer can provide a variety of shelf sizes by simply varying the number of central members that are provided. The shelving may be attached at each end to a slide to permit one or more shelves to extend outward from the inside of a cabinet.

12 Claims, 10 Drawing Sheets

(56) References Cited

U.S. PATENT DOCUMENTS 2,549,709 A * 4/1951 Potts ..... A47J 37/015 99/449
2,564,478 A * 8/1951 Harbison ..... F25D 25/02 312/351
3,027,016 A * 3/1962 Becht ..... A47B 55/02 211/153
3,252,434 A * 5/1966 Young, Jr. ..... A47F 5/13 211/181.1
3,300,056 A * 1/1967 Kaspar ..... A47B 55/02 211/181.1
3,765,634 A * 10/1973 Stempel ..... F16B 7/0433 403/384
3,998,170 A * 12/1976 Gordon ..... A47B 45/00 248/172
4,178,844 A * 12/1979 Ward ..... A47J 37/0694 248/172
4,553,523 A * 11/1985 Stohrer, Jr. ..... A47J 37/0694 99/449
4,646,658 A * 3/1987 Lee ..... A47B 96/025 108/62
5,520,118 A * 5/1996 McCarthy ..... A47B 55/02 211/90.03
5,584,405 A * 12/1996 Tunzi ..... A47B 45/00 D15/89
5,645,182 A * 7/1997 Miller, Jr. ..... A47F 5/12 211/175
5,810,179 A * 9/1998 Kleiman ..... A47B 55/02 211/90.03
6,148,813 A * 11/2000 Barnes ..... F24C 15/168 126/339
6,164,194 A * 12/2000 Westmoreland ..... A47J 43/18 99/449
6,189,527 B1 * 2/2001 Walsh ..... A47J 37/067 211/175
6,279,467 B1 * 8/2001 Tiemann ..... A21B 3/155 99/449
6,341,704 B1 * 1/2002 Michel, Jr. ..... A47L 19/04 211/119.011
6,349,717 B1 * 2/2002 Thompson ..... F24C 15/16 211/153
6,467,860 B2 * 10/2002 Remmers ..... A47B 88/402 312/334.7
6,497,331 B1 * 12/2002 Morandi ..... A47B 96/202 211/90.03
6,578,720 B1 * 6/2003 Wang ..... A47F 5/01 211/186
6,834,768 B2 * 12/2004 Jersey ..... A47B 73/002 211/175
6,976,596 B2 * 12/2005 Brooks ..... F24C 15/16 211/90.03
7,182,210 B2 * 2/2007 Metcalf ..... A47B 96/025 211/90.03
7,225,936 B2 * 6/2007 Jersey ..... A47B 73/002 211/189
D551,467 S * 9/2007 Kassanoff ..... D6/705.6
7,428,976 B2 * 9/2008 Cheng ..... B65D 7/20 220/676
7,497,533 B2 * 3/2009 Remmers ..... A47B 96/063 211/90.01
7,806,283 B2 * 10/2010 Metcalf ..... A47B 96/025 211/90.03
8,006,858 B2 * 8/2011 Cheng ..... A47B 55/02 220/494
8,065,999 B2 * 11/2011 Educate ..... A47J 37/0694 126/153
8,245,651 B1 * 8/2012 Mikich ..... A47F 5/0892 211/113
8,430,253 B1 * 4/2013 Jackson ..... A47B 97/00 211/90.03
9,420,884 B2 * 8/2016 Newman ..... F16M 13/027
9,474,368 B2 * 10/2016 Frankel ..... A47B 43/00
9,498,104 B2 * 11/2016 Ben-Haim ..... A47L 15/505
9,861,200 B2 * 1/2018 Lim ..... A47B 96/07
9,920,935 B2 * 3/2018 Stewart ..... F24C 15/168
10,499,733 B2 * 12/2019 Felsenthal ..... A47B 47/00
10,548,396 B1 * 2/2020 Hong ..... A47B 88/43
10,612,828 B1 * 4/2020 Engelbrect ..... F25D 25/02
10,663,177 B2 * 5/2020 Nelson ..... F24C 15/16
2005/0279041 A1 * 12/2005 Staples ..... A47F 5/0853 52/506.06
2007/0158289 A1 * 7/2007 Chen ..... A47B 47/00 211/186
2008/0054772 A1 * 3/2008 Koloff ..... F25D 25/024 312/404
2010/0288717 A1 * 11/2010 Morandi ..... A47B 55/02 211/187
2019/0223627 A1 * 7/2019 Standen ..... A47F 1/121
2019/0290000 A1 * 9/2019 Davis ..... A47B 96/021
2020/0138187 A1 * 5/2020 Lim ..... A47B 47/021

* cited by examiner

WIRE SHELF

CROSS-REFERENCE TO RELATED APPLICATIONS

This application is a continuation of U.S. patent application Ser. No. 17/147,207, filed Jan. 12, 2021, the contents of which are herein incorporated by reference.

BACKGROUND OF THE INVENTION

1. Field of the Invention

Embodiments of the invention relate generally to wire shelving. More particularly, embodiments of the invention relate to wire shelving that can be easily adjusted to a user-desired width.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Wire shelving can be used in various locations and for various purposes. For example, a wire shelf can be designed to fit inside a cabinet, such as a kitchen cabinet, where the shelf may be disposed on slides to permit movement of the shelf outward from the cabinet. Such cabinets are typically designed in various widths. However, if a user purchases such a shelf system for one particular cabinet, they may not have any option to move that shelf system to a cabinet of a different width.

One option available to a user who has a shelf system of a width smaller than the cabinet is to build an interior wall to attach the shelf system. This, however, requires substantial customization and can take up additional space inside the cabinet.

In view of the foregoing, there is a need for wire shelving that permits the shelving to be installed in cabinets of various widths.

SUMMARY OF THE INVENTION

Embodiments of the present invention provide a modular wire shelf comprising a central member having a first side outer rod and a second side outer rod; a first side end member having an inside rod forming a first removable engagement with the first side outer rod; and a second side end member having an inside rod forming a second removable engagement with the second side outer rod; wherein when assembled, the central member, the first side end member and the second side end member form a planar wire shelf; and the first side outer rod of a first one of the central member is configured to removable engage with the second side outer rod of a second one of the central member, such that one or more of the central member are engageable between the first side end member and the second side end member.

Embodiments of the present invention further provide a modular wire shelf assembly comprising a wire shelf; a slide member attached to each side of the wire shelf; and a slide base member for securing inside an enclosure, the slide base member slidably receiving each of the slide members to permit the wire shelf to slide inside and outside an enclosure, wherein the wire shelf comprises a central member having a first side outer rod and a second side outer rod, the central member further including central member front and rear rods between which the first side outer rod and the second side outer rod extend, a first side end member having an inside rod forming a first removable engagement with the first side outer rod, the first side member further including first side end member front and rear rods between which the first side outer rod extends, and a second side end member having an inside rod forming a second removable engagement with the second side outer rod, the second side member further including second side end member front and rear rods between which the first side outer rod extends, wherein when assembled, the central member, the first side end member and the second side end member form a planar wire shelf; when assembled, the central member front and rear rods align with respective first side end member front and rear rods and respective second side end member front and rear rods; and the first side outer rod of a first one of the central member is configured to removable engage with the second side outer rod of a second one of the central member, such that one or more of the central member are engageable between the first side end member and the second side end member.

Embodiments of the present invention also provide a modular wire shelf comprising a central member having a first side outer rod and a second side outer rod, the central member further including central member front and rear rods between which the first side outer rod and the second side outer rod extend, one of the first side outer rod and the second side outer rod being hollow, the other being solid; a first side end member having an inside rod forming a first removable engagement with the first side outer rod, the first side member further including first side end member front and rear rods between which the first side outer rod extends, wherein the inside rod is either hollow to receive the solid one of the first and second outer rods of the central member, or the inside rod is solid to fit into the hollow one of the first and second outer rods of the central member; and a second side end member having an inside rod forming a second removable engagement with the second side outer rod, the second side member further including second side end member front and rear rods between which the first side outer rod extends, wherein when the inside rod of the first side end member is hollow, the inside rod of the second side end member is solid, and when the inside rod of the first side end member is solid, the inside rod of the second side end member is hollow, wherein when assembled, the central member, the first side end member and the second side end member form a planar wire shelf; when assembled, the central member front and rear rods align with respective first side end member front and rear rods and respective second side end member front and rear rods; and the first side outer rod of a first one of the central member is configured to removably engage with the second side outer rod of a second one of the central member, such that one or more of the central member are engageable between the first side end member and the second side end member.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
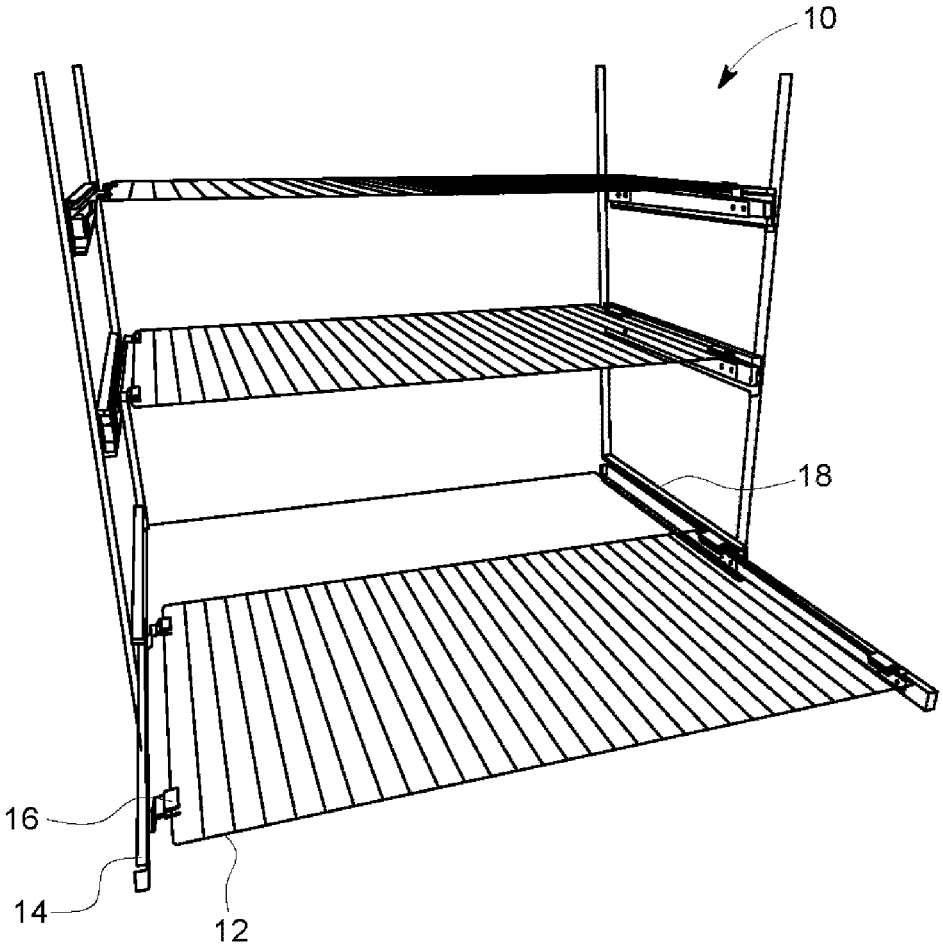
FIG. 1 illustrates a perspective view of an assembled wire shelving system suitable for installation in a cabinet, according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any apparatus, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a storage solution using wire shelves. The width of the wire shelves can be customized by a user by adding one or more central members between two end members. Thus, the shelving can be installed in one cabinet having a first width, and moved, if desired, to a cabinet of a different width by adding or removing central members from the shelf. The shelving may be attached at each end to a slide to permit one or more shelves to extend outward from the inside of a cabinet.

Further embodiments of the present invention provide a storage solution where a ladder mount can be used to support a shelving slide or the shelving member itself. The ladder mount can be attached to and extend upward from a base of a cabinet. Two or more ladder mounts can be used to support the shelf and/or shelf slide. The ladder mount can permit a shelving system having a width smaller than a cabinet width, to be installed in a cabinet, where one side of the shelf and/or shelf slide can attach to a cabinet side wall, and the other side of the shelf and/or shelf slide can attach to a free-standing ladder mount system.

Referring to FIGS. 1 and 2, a modular width shelving system 10 can include a wire shelf 12, as described in greater detail below. The wire shelf 12 can be attached, via attachment elements 16, to a sliding member 14 that slides and extends from a slide base 18. In some embodiments, the modular width shelving system 10 can be used inside a cabinet or other similar space, where the wire shelf 12 can be designed to extend outward from the opening or cabinet.

Typically, one or more wire shelves 12 can be disposed in an opening. As shown in FIG. 1, three wire shelves 12 may be positioned in an opening, such as inside a cabinet.

While the wire shelf 12 is shown attached to sliding members 14 on each side thereof, in some embodiments, the wire shelf 12 may be fixed and attached directly to a side wall (not shown) or to a ladder mount, as described in detail below. In some embodiments, one or more wire shelves 12 may be fixed and/or one or more wire shelves may include sliding members 14 and slide bases 18.

Regardless of the number of shelves and their attachment, the wire shelf 12 may be formed from multiple components as shown in FIG. 2. Such components can include a first side end member 22, a second side end member 20, and one or more central members 24. The wire shelf 12 can be designed with any number of central members 24 to permit changes in width. The central members 24 may each be of a fixed width or may be designed in various widths. For example, a 20-inch wire shelf may be installed inside a 24-inch cabinet. This may be designed with the end members 20, 22 each having a 2.5-inch width, for example, and six central members 24, each having a 2.5-inch width. In other embodiments, the 2.5-inch end members 20, 22 may be connected to a single 15-inch central member. Typically, however, the central members may be uniformly sized so that a multiple of central members 24, when attached to the end members 20, 22, may fit into most standard sized cabinets, such as 36-inch, 30-inch, 24-inch, 18-inch or the like.

As discussed below, the wire shelf 12 can be designed with hollow and solid poles to permit an easy efficient assembly and/or change in width. Referring now to FIGS. 2A through 2E, as well as FIGS. 4A through 4C, in some embodiments, the first side end member 22 can include a hollow rod 32 along an inside edge thereof. The central member 24 can include a solid rod 34 adjacent the first side end member 22 and a hollow rod 36 on the side opposite the solid member 34.

Figure 2A:
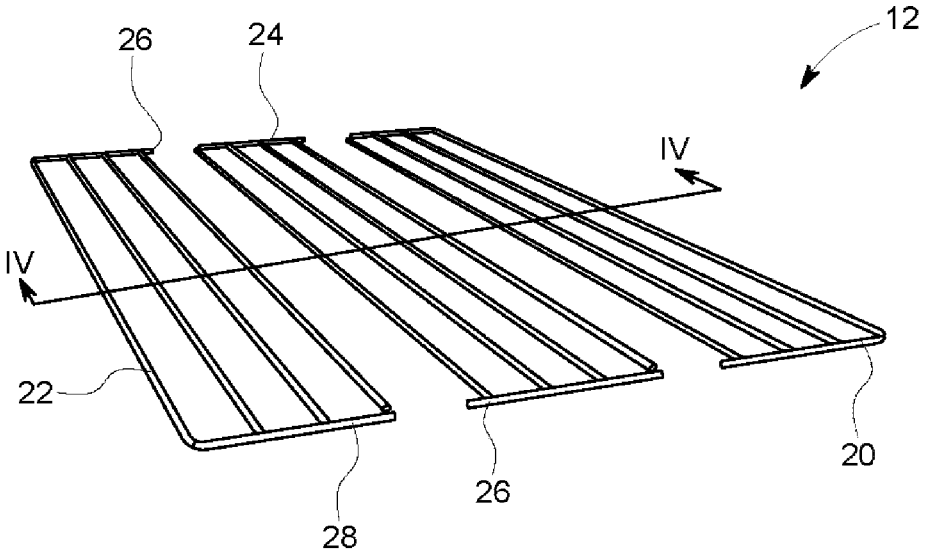
FIG. 2A illustrates an exploded view of one of the wire shelves of the wire shelving system of FIG. 1.
Figure 2B:
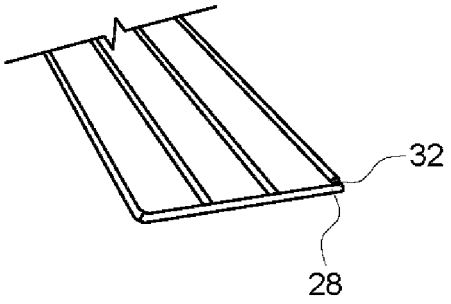
FIG. 2B illustrates a detailed end view of a front portion of the first side end member of FIG. 2A.
Figure 2C:
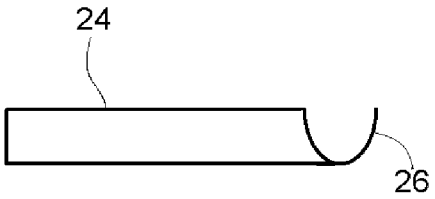
FIG. 2C illustrates a side view of the central member of FIG. 2A, showing a U-shape along an engagement member thereof.
Figure 2D:
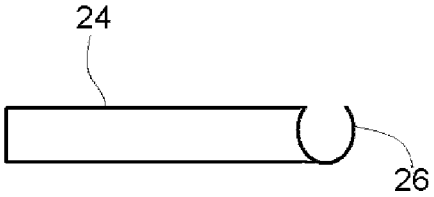
FIG. 2D illustrates a side view of the central member of FIG. 2A, showing a C-shape along an engagement member thereof.
Figure 2E:
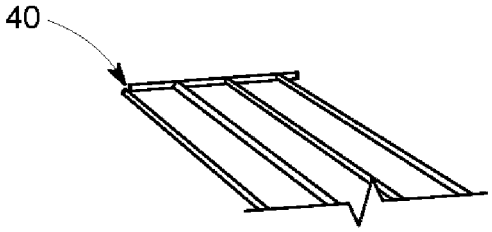
FIG. 2E illustrated a detail view of a back end of the central member of FIG. 2A.

As shown in FIG. 2D, a space 40 may be provided between a back end wall of the central member 24 and the solid rod 34. Similarly, as shown in FIG. 2B, a front end rod 28 of the first side end member 22 may not connect to the end of the hollow member 32. This design allows the hollow rod 32 to receive the solid rod 34, as discussed below with respect to FIGS. 3A through 3I. Similarly, the hollow rod 36 of the central member 24 may be configured to receive a solid rod 38 of the second side end member 20. Optionally, the hollow rod 36 of the central member 24 can receive a solid member 34 of another central member 24 in order to further increase the width of the wire rack 12.

The front rods and rear rods of each of the end members 20, 22 and the central member 24 can include an engagement member 26 extending from one of the front rods and rear rods thereof. For example, as shown in FIG. 2A, a rear rod of the first side end member 22 can have an engagement member 26 extending beyond the end of the hollow rod 32. The engagement member 26 may be designed to engage with the rear rod of the central member 24 upon assembly thereof, as discussed below with respect to FIGS. 3A through 3I.

The central member 24 may include one engagement member 26 on one side of a front rod (such as on a left hand side of the front rod of the central member 24, as shown in FIG. 2A) and another engagement member 26 on the other side of a rear rod (such as on the right hand side of the rear rod of the central member 24, as shown in FIG. 2A. This design permits multiple central members 24 to be interconnected in series to create a wire shelf 12 having an expandable width.

In some embodiments, as shown in the end view of central member 24 in FIG. 2C, the engagement member 26 can be formed as a U-shape, with the opening of the U facing upward during assembly, where the U-shape can be configured to receive the front rod 28 therein. When the wire shelf 12 is turned upside down (from the U-shape facing upward to the U-shape facing downward), the base of the U-shape, supporting the front rod 28 therein, can prevent downward flexing of the wire shelf 12 at the joint between the hollow rod 32 of the first side end member 22 and the solid rod 34 of the central member 24. While the engagement member 26 is shown as a relative short section, the length of the engagement member 26 may be extended longer, up to the length of the front rod 28, for example, to provide adequate engagement between the first side end member 22 and the central member 24. In some embodiments, the U-shape may be curved inward at the open end, to form more of a C-shape, as shown in FIG. 2D where the front rod 28 may snap fit into the C-shape engagement member 26.

In some embodiments, a supplemental rod (not shown) may be fit along one or both of the front and back ends of the wire shelf 12, once assembled to a desired width. The supplemental rod may span one or more of the joints between the various members in order to further stabilize the assembly. In this embodiment, the engagement members 26 may not be required.

Figure 3A:
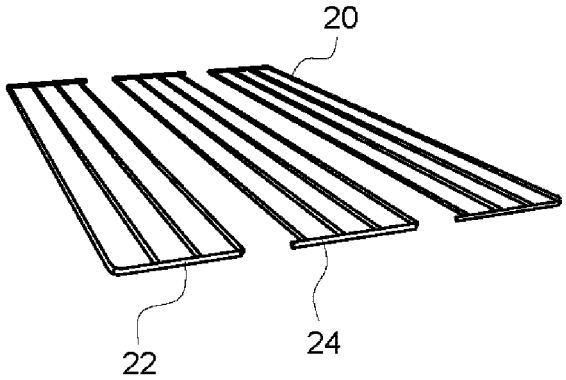
FIG. 3A illustrates a pre-assembled view of an adjustable-width wire shelf.

Referring now to FIGS. 3A through 3I, an exemplary assembly method is described, further referring to FIGS. 2A through 2E and FIGS. 4A through 4C. It should be understood that the below represents one possible implementation of the present invention. First, a user can determine how wide they would like their shelf and arrange the first side end member 22 and the second side end member 20 at ends of one or more central members 24. In the embodiment of FIG. 3A, for simplicity, only one central member 24 is illustrated.

Figure 3B:
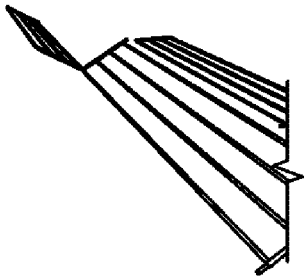
FIG. 3B illustrates a first step in the interconnection of a first side end member with a central member, according to an exemplary embodiment of the present invention.
Figure 3C:
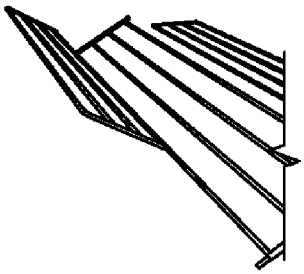
FIG. 3C illustrates the first side end member further sliding onto the central member.
Figure 3D:
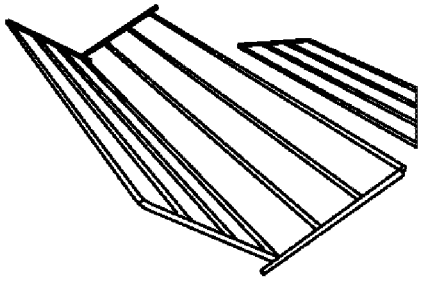
FIG. 3D illustrates the first side end member fully slid onto the central member.
Figure 3E:
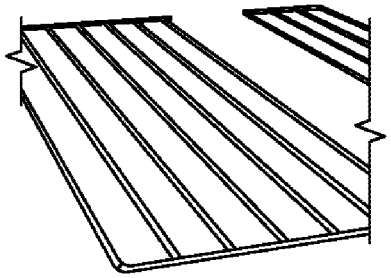
FIG. 3E illustrates the first side end member being moved to a position co-planar with the central member.

As shown in FIGS. 3B and 3C, the user can slide the solid rod 34 of the central member 24 into the hollow rod 26 of the first side end member 22. Typically, one can slide these pieces together at an angle, as shown. As shown in FIGS. 3D and 3E the user can fully slide the pieces together and flatten then into the same plane (FIG. 3E). When doing so, the engagement member 26 at the front of the central member 24 can engage with the front of the first side end member 22 while the engagement member 26 at the rear of the first side end member 22 can engage with the rear of the central member 24.

Figure 3F:
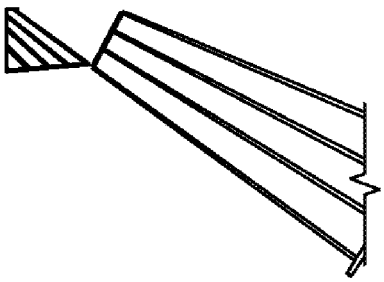
FIG. 3F illustrates a first step in the interconnection of a second side end member with a central member, according to an exemplary embodiment of the present invention.
Figure 3G:
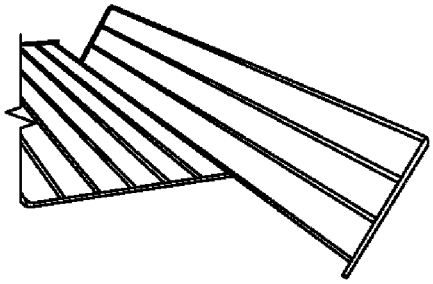
FIG. 3G illustrates the second side end member further sliding onto the central member.
Figure 3H:
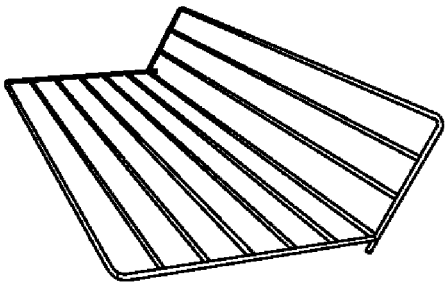
FIG. 3H illustrates the second side end member fully slid onto the central member.
Figure 3I:
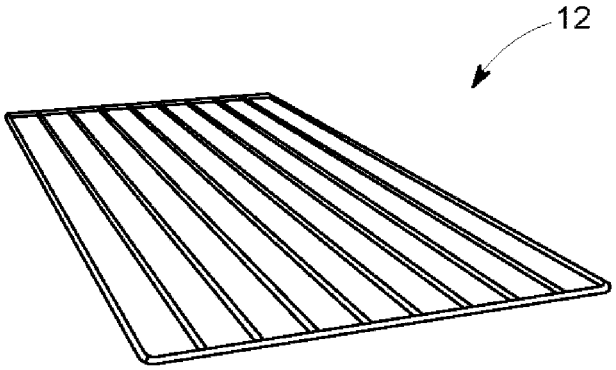
FIG. 3I illustrates the second side end member being moved to a position co-planar with the central member and the first side end member, thus completing assembly of the wire shelf.

The second side end member 20 can be positioned in a similar manner, with the solid rod 38 of the second side end member 20 being slid into the hollow rod 26 of the central member 24 as shown in FIGS. 3F through 3H. As shown in FIGS. 3H and 3I, the user can fully slide the pieces together and flatten then into the same plane (FIG. 3I). When doing so, the engagement member 26 at the rear of the central member 24 can engage with the rear of the second side end member 20 while the engagement member 26 at the front of the second side end member 20 can engage with the front of the central member 24.

Once the assembly is complete, the wire shelf 12 can be turned upside down (relative to the assembly described above) so that the engagement members 26 prevent downward pivoting where the end members 20, 22 connect to the central member 24. The wire shelf 12 can then be installed as desired.

Figure 4A:
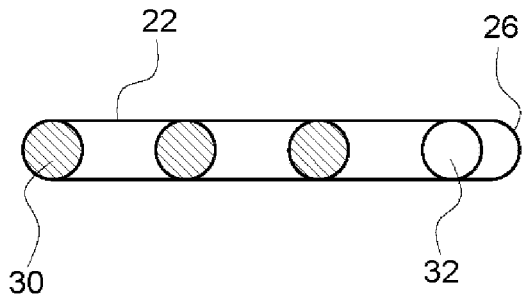
FIG. 4A illustrates a cross-sectional view of the first side end member, taken along line IV-IV of FIG. 2.
Figure 4B:
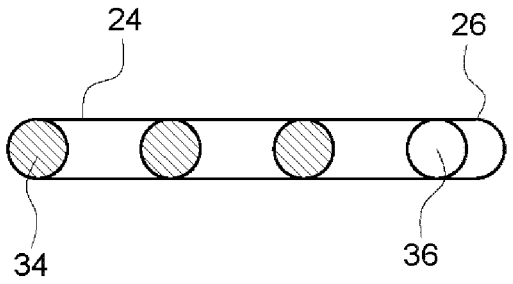
FIG. 4B illustrates a cross-sectional view of the central member, taken along line IV-IV of FIG. 2.
Figure 4C:
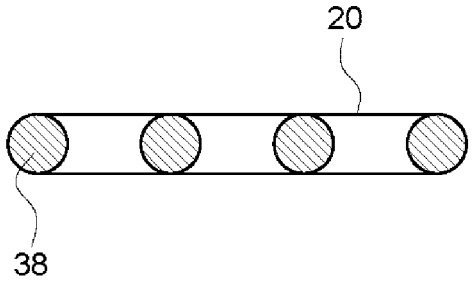
FIG. 4C illustrates a cross-sectional view of the second side end member, taken along line IV-IV of FIG. 2.

It should be understood that the orientation of the solid and hollow rods may be reversed, provided that the central member includes a rod along one side being solid and a rod along the opposite side being hollow. Further, while the cross-sectional views of FIGS. 4A through 4C show non-linking rods as being solid (such as rod 30, on the outer edge of the first side end member 22), these rods may be solid, hollow, partially filled, or the like.

The depth of the shelf may be, for example, designed for inside a cabinet and should match or be slightly shorter than an inside thereof. Of course, depending on application, the depth may be changed accordingly. Further, in some embodiments, the depth of the wire shelf may be adjustable while the length remains constant.

Figure 5:
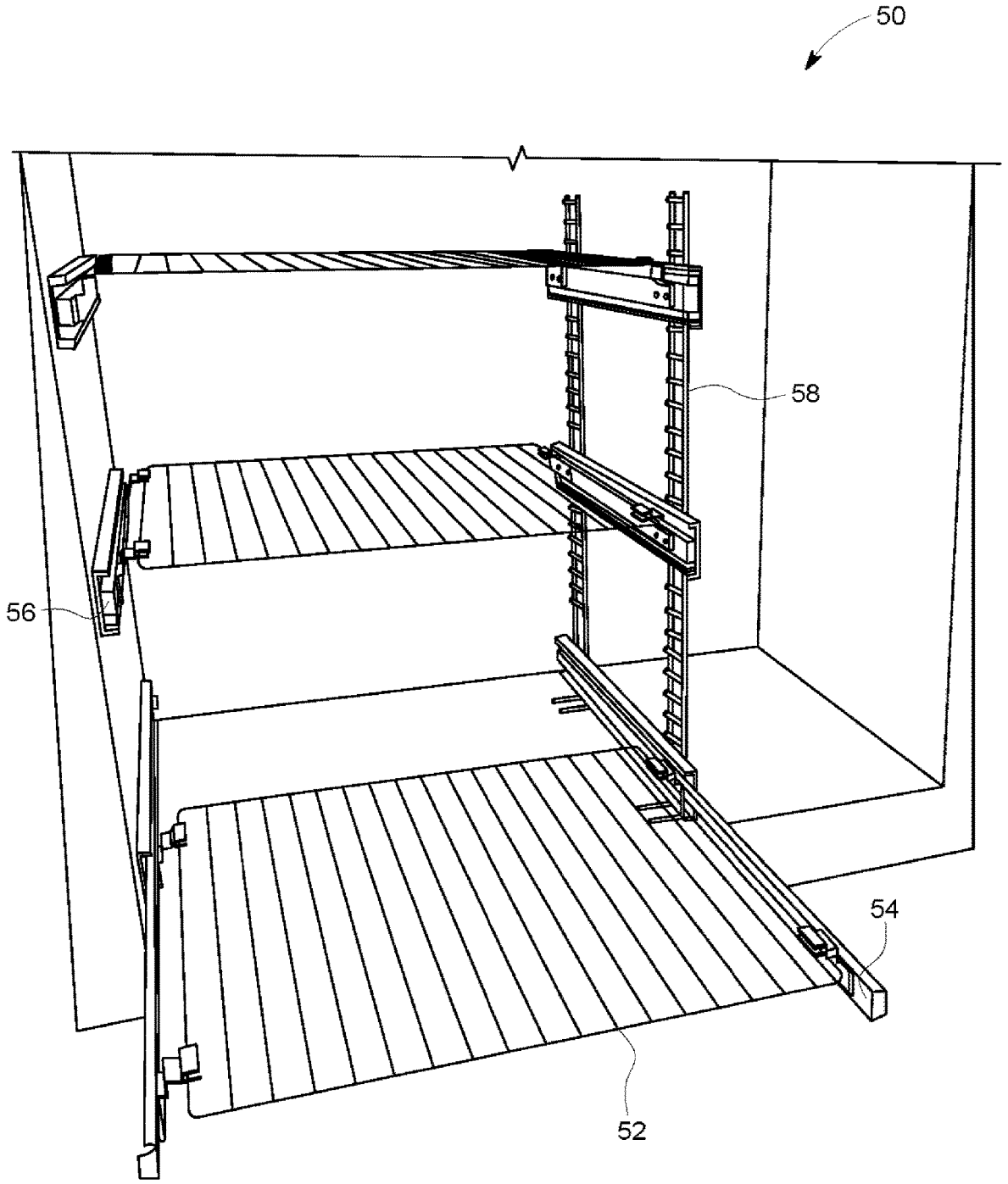
FIG. 5 illustrates a perspective view of a wire shelving system supported on one side by a shelving ladder system according to an exemplary embodiment of the present invention.

Referring to FIG. 5, the wire shelf 12 described above, or any a typical wire shelf 52 may be disposed between two sliding rails 54 mounted in fixed rails 56. One side of the fixed rails 56 may be mounted to a side wall 84 of the cabinet, shown on the left side of the fixed rails 56. When the shelf 52 does not span the entire width of the enclosure, ladder mounts 58 may be used to attach the fixed rails 56. The ladder mounts 58 may run substantially perpendicular to a base 82 of the enclosure and extend upward. The ladder mounts 58 can include two or more side rails 60 with a plurality of spaced apart rungs 62 disposed there between. Feet 80 of the ladder mounts 58 can be supported by the base 82 of the enclosure. Various types of attachment mechanisms may be used to secure the feet 80 to the base 82 of the enclosure. Such attachment mechanisms can include one or more of screw holes, an anti-slip coating, barbed feet, staples, or the like.

Figure 6:
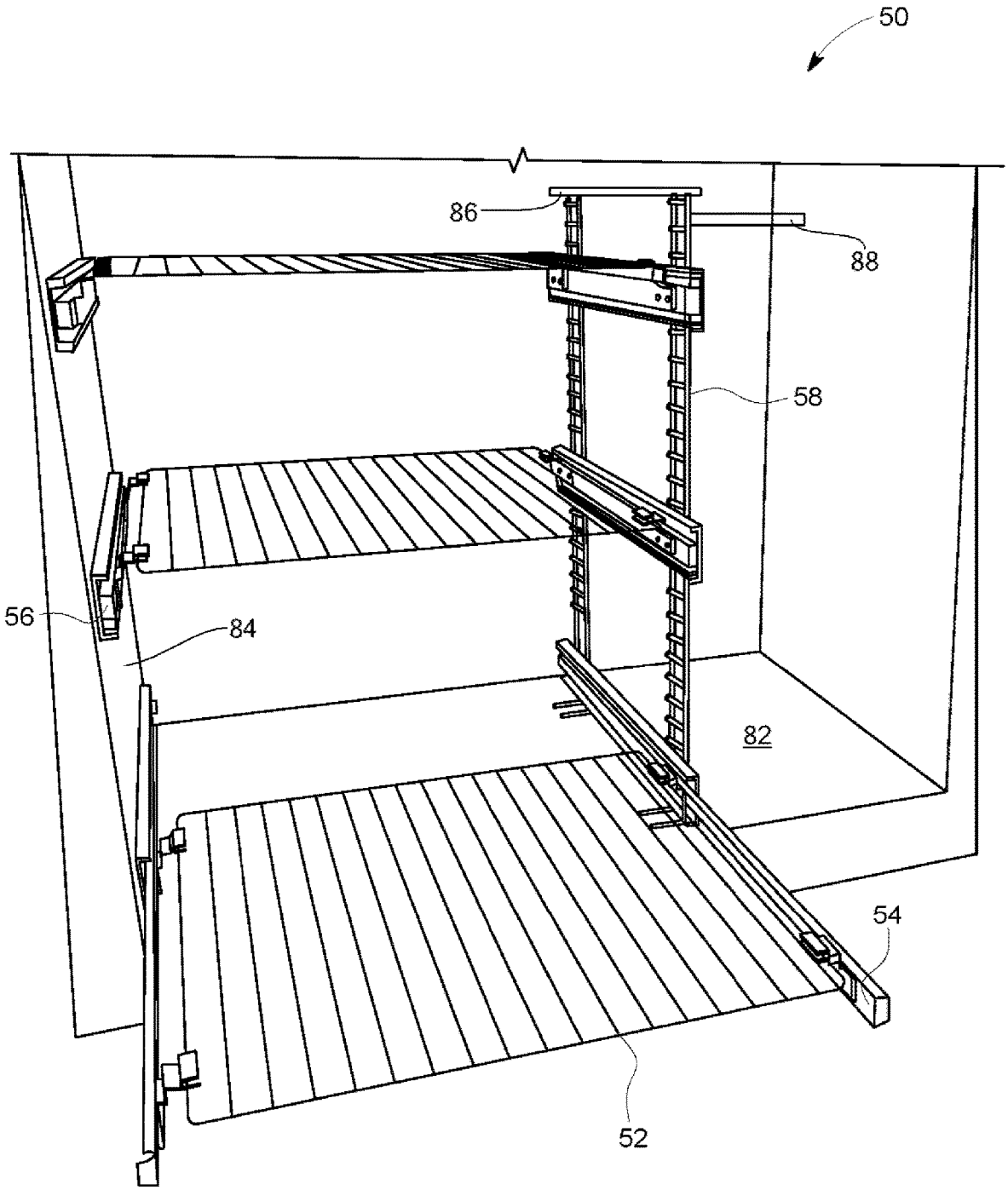
FIG. 6 illustrates a perspective view of a wire shelving system supported on one side by a shelving ladder system, the ladder system including additional supports, according to an exemplary embodiment of the present invention.

Referring to FIG. 6, in some embodiments, an upper end of the ladder mounts 58 can be attached together with an attachment rail 86. The attachment rail 86 may further attach to a back surface of the enclosure. Further, the ladder mounts 58 may attach to an opposite side wall with extensions 88. The extensions 88 may be lockable telescoping members, for example, to allow for different distances between the ladder mounts 58 and the side wall of the enclosure. Other stabilization mechanisms, as may be understood by one skilled in the art, may be used to help maintain the position of the ladder mounts once positioned.

While the figures show the use of two ladder mounts 58, any number of ladder mounts 58, typically two or more, may be used to support the shelf 52. Further, while FIGS. 5 and 6 show the left side fixed rails 56 are fixed to the side wall 84, when no side walls are available, the ladder mounts 58 may be disposed on both sides of the shelf 52.

Figure 7:
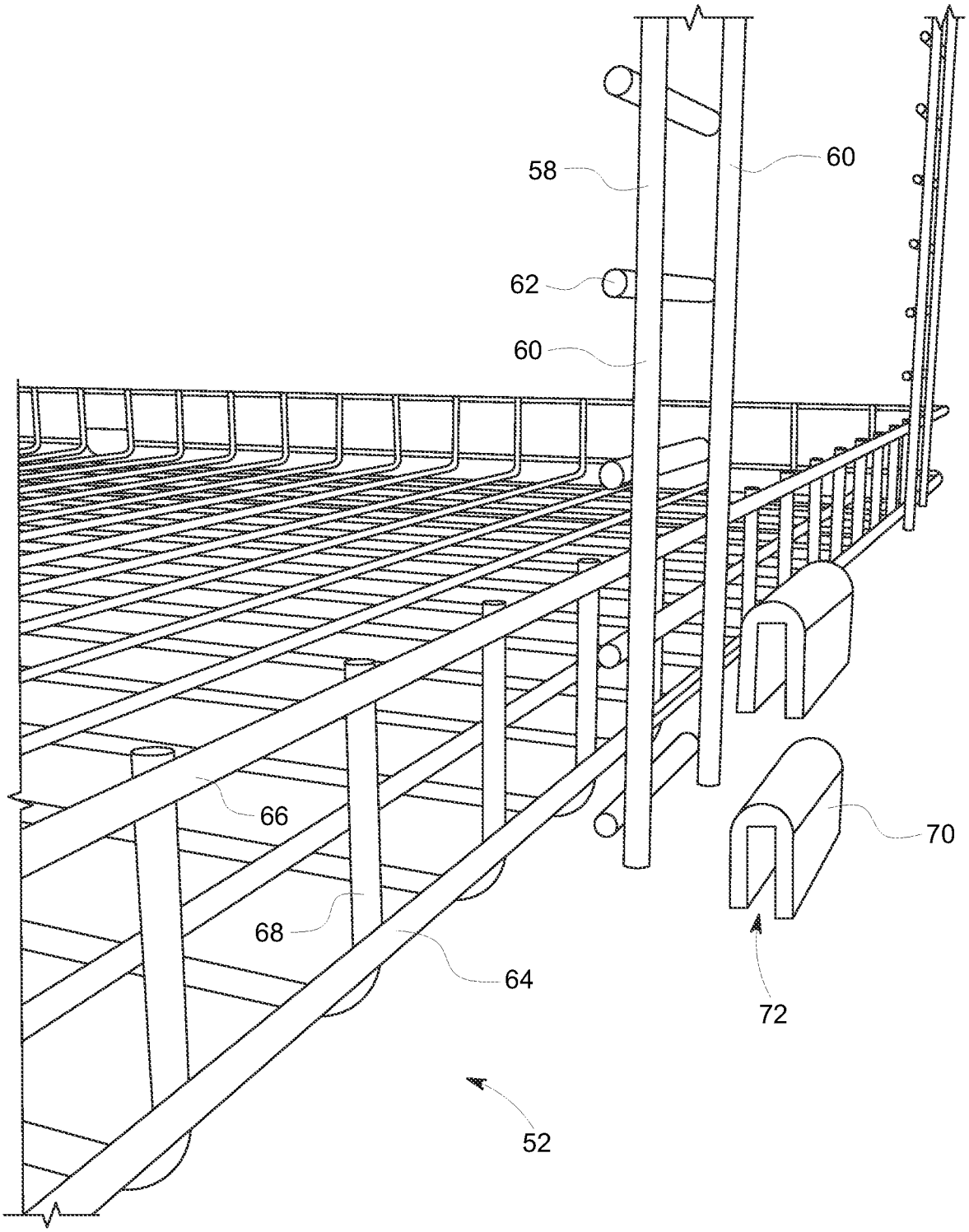
FIG. 7 illustrates a detailed perspective view showing attachment of a fixed wire shelving member to a shelving ladder system according to an exemplary embodiment of the present invention.

Referring to FIG. 7, the shelf may be designed as a basket with side rails 64, 66 disposed about an outer perimeter thereof. Such a design may be particularly suited for use with the ladder mounts 58, as the rungs 62 can attach to an inside surface of the rails 60 and the side rails 64, 66 of the basket may be spaced apart with a spacing equivalent to the spacing of the rungs 62. In this embodiment, the rungs 62 may be positioned below each of the side rails 64, 66 to provide vertical (weight-bearing) support for the basket. Clips 70 may be used to secure the rungs 62 to the side rails 64, 66. The clips 70 may be U-shaped with an inside width designed to frictionally fit the rungs 62 there inside. Such a design can prevent the side rails 64, 66 from sliding along side of the rungs 62 when weight is supported by the basket.

While FIGS. 5 through 7 show wire shelving, the ladder mount may be useful to provide a side support for any shelving installation where a side wall is unavailable.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A modular wire shelf comprising:

a central member having a first side outer rod and a second side outer rod;

a first side end member having a first side end member inside rod forming a first removable engagement with the first side outer rod; and a second side end member having a second side end member inside rod forming a second removable engagement with the second side outer rod, wherein when assembled, the central member, the first side end member and the second side end member form a planar wire shelf with the first side outer rod and the second side outer rod directly attached, along a respective length thereof, with respective ones of the first side end member inside rod and the second side end member inside rod;

a first engagement member formed as an extension of a first side end member rear rod beyond the first side end member inside rod;

a second engagement member formed as an extension of a central member rear rod beyond the second side outer rod of the central member;

a third engagement member formed as an extension of a central member front rod beyond the first side outer rod of the central member; and a fourth engagement member formed as an extension of a second side end member front rod beyond the second side end member inside rod, wherein:

the first side end member inside rod is hollow;

one of the first side outer rod and the second side outer rod of the central member is hollow and the other one of the first side outer rod and the second side outer rod of the central member is solid and fits into the hollow inside rod of the first side end member; and the second side end member inside rod is solid and fits into the hollow one of the first side outer rod and the second side outer rod of the central member.

2. The modular wire shelf according to claim 1, wherein:

the central member further includes the central member front and rear rods between which the first side outer rod and the second side outer rod extend;

the first side end member further includes the first side end member front and rear rods between which the first side end member inside rod extends; and the second side end member further includes second side end member front and rear rods between which the second side end member inside rod extends wherein when assembled, the central member front and rear rods align with respective first side end member front and rear rods and respective second side end member front and rear rods.

3. The modular wire shelf according to claim 1, wherein each of the first, second, third and fourth engagement members are formed in a U-shape to receive a portion of the wire shelf therein when assembled.

4. The modular wire shelf according to claim 1, wherein each of the first, second, third and fourth engagement members are formed in a C-shape to receive a portion of the wire shelf therein when assembled.

5. The module wire shelf according to claim 1, wherein:

the first engagement member engages with a portion of the central member rear rod when the wire shelf is assembled;

the second engagement member engages with a portion of the second side end member rear rod when the wire shelf is assembled;

the third engagement member engages with a portion of the first side end member front rod when the wire shelf is assembled; and the fourth engagement member engages with a portion of the central member front rod when the wire shelf is assembled.

6. A modular wire shelf assembly comprising:

a central member having a first side outer rod and a second side outer rod;

a first side end member having a first side end member inside rod forming a first removable engagement with the first side outer rod;

a second side end member having a second side end member inside rod forming a second removable engagement with the second side outer rod; and a plurality of engagement members configured to retain the wire shelf as a planar wire shelf during use thereof, wherein the plurality of engagement members include:

a first engagement member extending from one of a front end or a rear end of the first side end member inside rod, extending beyond the first side end member inside rod, toward the central member;

a second engagement member extending from either (a) a front end of the second side end member inside rod when the first engagement member extends from the rear end of the first side end member inside rod, or (b) a rear end of the second side end member inside rod when the first engagement member extends from the front end of the first side end member inside rod, the second engagement member extending beyond the second side end member inside rod, toward the central member;

a third engagement member extending from either (a) a front end of the first side outer rod when the first engagement member extends from the rear end of the first side end member inside rod, or (b) a rear end of the first side outer rod when the first engagement member extends from the front end of the first side end member inside rod, the third engagement member extending beyond the first side outer rod, toward the first side end member; and a fourth engagement member extending from either (a) a front end of the second side outer rod when the second engagement member extends from the rear end of the second side end member inside rod, or (b) a rear end of the second side outer rod when the second engagement member extends from the front end of the second side end member inside rod, the fourth engagement member extending beyond the second side outer rod, toward the second side end member, wherein when assembled, the central member, the first side end member and the second side end member form the planar wire shelf with the first side outer rod and the second side outer rod directly attached, along a respective length thereof, with respective ones of the first side end member inside rod and the second side end member inside rod; and the first side outer rod of a first one of the central member is configured to removably engage with the second side outer rod of a second one of the central member, such that one or more of the central member are engageable between the first side end member and the second side end member to adjust an overall width of the modular wire shelf.

7. The modular wire shelf according to claim 6, wherein each of the first, second, third and fourth engagement members engage into U-shaped portions of the modular wire shelf.

8. The modular wire shelf according to claim 6, wherein:

the central member further includes central member front and rear rods between which the first side outer rod and the second side outer rod extend;

the first side end member further includes first side end member front and rear rods between which the first side end member inside rod extends; and the second side end member further includes second side end member front and rear rods between which the second side end member inside rod extends wherein when assembled, the central member front and rear rods align with respective first side end member front and rear rods and respective second side end member front and rear rods.

9. The modular wire shelf of claim 8, wherein:

the first engagement member is formed as an extension of one of the first side end member front rod or the first side end member rear rod;

the second engagement member is formed as an extension of one of the second side end member front rod or the second side end member rear rod; and the third and fourth engagement members are formed as extensions of respective ones of the central member front and rear rods.

10. The modular wire shelf of claim 9, wherein:

the first engagement member fits into a U-shaped portion of one of the central member front and rear rods;

the second engagement member fits into a U-shaped portion of one of the central member front and rear rods;

the third engagement member fits into a U-Shaped portion of one of the first side end member front and rear rods; and the fourth engagement member fits into a U-Shaped portion of one of the second side end member front and rear rods.

11. A modular wire shelf comprising:

a central member having a first side outer rod and a second side outer rod, one of the first side outer rod and the second side outer rod being hollow, the other being solid;

a first side end member having a first side inside rod forming a first removable engagement with the first side outer rod, wherein the first side inside rod is either hollow to receive the solid one of the first and second outer rods of the central member, or the first side inside rod is solid to fit into the hollow one of the first and second outer rods of the central member;

a second side end member having a second side inside rod forming a second removable engagement with the second side outer rod, wherein when the first side inside rod of the first side end member is hollow, the second side inside rod of the second side end member is solid, and when the first side inside rod of the first side end member is solid, the second side inside rod of the second side end member is hollow;

a first engagement member formed as an extension of a first side end member rear rod beyond the first side inside rod of the first side end member;

a second engagement member formed as an extension of a central member rear rod beyond the second side outer rod of the central member;

a third engagement member formed as an extension of a central member front rod beyond the first side outer rod of the central member; and a fourth engagement member formed as an extension of a second side end member front rod beyond the second side inside rod of the second side end member, wherein when assembled, the central member, the first side end member and the second side end member form a planar wire shelf; and the first side outer rod of a first one of the central member is configured to removably engage with the second side outer rod of a second one of the central member, such that one or more of the central member are engageable between the first side end member and the second side end member.

12. The module wire shelf according to claim 11, wherein:

the first engagement member engages with a portion of the central member rear rod when the wire shelf is assembled;

the second engagement member engages with a portion of the second side end member rear rod when the wire shelf is assembled;

the third engagement member engages with a portion of the first side end member front rod when the wire shelf is assembled; and the fourth engagement member engages with a portion of the central member front rod when the wire shelf is assembled.

* * * * *